US007972133B2

(12) United States Patent
Bernero et al.

(10) Patent No.: US 7,972,133 B2
(45) Date of Patent: Jul. 5, 2011

(54) BURNER FOR THE OPERATION OF A HEAT GENERATOR AND METHOD OF USE

(75) Inventors: Stefano Bernero, Oberrohrdorf (CH); Peter Flohr, Turgi (CH); Gijsbertus Oomens, Nussbaumen (CH); Martin Zajadatz, Dangstetten/Kuessaberg (DE)

(73) Assignee: ALSTOM Technology Ltd., Baden (CH)

( * ) Notice: Subject to any disclaimer, the term of this patent is extended or adjusted under 35 U.S.C. 154(b) by 182 days.

(21) Appl. No.: 12/238,792

(22) Filed: Sep. 26, 2008

(65) Prior Publication Data

US 2009/0081599 A1 Mar. 26, 2009

Related U.S. Application Data

(63) Continuation of application No. PCT/EP2007/052031, filed on Mar. 5, 2007.

(30) Foreign Application Priority Data

Mar. 27, 2006 (CH) ..... 477/06

(51) Int. Cl.
*F23Q 9/00* (2006.01)

(52) U.S. Cl. ..... 431/278; 431/162; 431/174; 431/175; 431/181; 431/285; 431/287; 431/6

(58) Field of Classification Search ..... 431/6, 287, 431/285, 278, 181, 175, 174, 162
See application file for complete search history.

(56) References Cited

U.S. PATENT DOCUMENTS 1,886,866 A * 11/1932 Blakesley ..... 431/172
1,920,186 A * 8/1933 Carter ..... 431/175
5,073,104 A * 12/1991 Kemlo ..... 431/12

(Continued)

FOREIGN PATENT DOCUMENTS

EP 0321809 6/1989

(Continued)

OTHER PUBLICATIONS

Von Miller, R., et al., Lueger Lexikon Der Technik, Band 7, Lexikon der Energietechnik and Kratmaschinen, (1965), p. 600, Deutsche Verlags-Anstalt GmbH, Stuttgart, Germany.

(Continued)

*Primary Examiner* — Kenneth B Rinehart
*Assistant Examiner* — Jorge Pereiro
(74) *Attorney, Agent, or Firm* — Cermak Nakajima LLP; Adam J. Cermak

(57) ABSTRACT

A burner (23) for operating a heat generator includes a swirler (2) for a combustion air flow (9), and also devices (7, 12) for injecting at least one fuel into the combustion air flow (9), wherein a mixing path (3) is arranged downstream of the swirler (2), and wherein at least one nozzle (20) for feeding liquid pilot fuel is arranged in the region radially outside the discharge opening of the mixing path (3) of the burner. With such a burner, an operating mode which is as pollutant-free and overheating-free as possible can be enabled even at low load and under transient conditions if the at least one nozzle (20) is arranged in a burner front plate (32), wherein at least one discharge opening (15), through which the pilot fuel discharges into the combustion chamber (16), is provided in a front face (34) of the burner front plate (32), which is arranged essentially parallel to a combustion chamber rear wall (28).

12 Claims, 3 Drawing Sheets

U.S. PATENT DOCUMENTS

| | | | | |
|---|---|---|---|---|
| 5,081,843 | A * | 1/1992 | Ishibashi et al. | 60/733 |
| 5,660,044 | A * | 8/1997 | Bonciani et al. | 60/737 |
| 5,713,327 | A * | 2/1998 | Tilton et al. | 123/299 |
| 5,951,882 | A * | 9/1999 | Simmons et al. | 216/83 |
| 6,186,775 | B1 * | 2/2001 | Jansohn et al. | 431/285 |
| 6,210,152 | B1 * | 4/2001 | Haffner et al. | 431/12 |
| 6,331,109 | B1 | 12/2001 | Paikert et al. | |
| 7,140,183 | B2 * | 11/2006 | Ruck et al. | 60/737 |
| 7,520,745 | B2 * | 4/2009 | Oomens et al. | 431/354 |
| 2005/0164138 | A1 * | 7/2005 | Ruck et al. | 431/2 |
| 2007/0172783 | A1 * | 7/2007 | Stephens et al. | 431/278 |
| 2007/0172784 | A1 * | 7/2007 | Stephens et al. | 431/278 |
| 2007/0172785 | A1 * | 7/2007 | Stephens et al. | 431/278 |

FOREIGN PATENT DOCUMENTS

| | | |
|---|---|---|
| EP | 0670456 | 9/1995 |
| EP | 0704657 | 4/1996 |
| EP | 0780629 | 6/1997 |
| EP | 0794383 | 9/1997 |
| EP | 0924461 | 6/1999 |
| EP | 0931980 | 7/1999 |
| EP | 0994300 | 4/2000 |
| EP | 1389713 | 8/2002 |
| EP | 1321715 | 6/2003 |
| WO | W02007/110298 | 10/2007 |

OTHER PUBLICATIONS

Search Report for Swiss Patent App. No. 0477/2006 (Jul. 17, 2006).

International Search Report for PCT Patent App. No. PCT/EP2007/052031 (Aug. 24, 2007).

* cited by examiner

BURNER FOR THE OPERATION OF A HEAT GENERATOR AND METHOD OF USE

This application is a Continuation of, and claims priority under 35 U.S.C. §120 to, International application no. PCT/EP2007/052031, filed 5 Mar. 2007, and claims priority therethrough under 35 U.S.C. §§119, 365 to Swiss application no. 0477/06, filed 27 Mar. 2006, the entireties of which are incorporated by reference herein.

BACKGROUND

1. Field of Endeavor

The present invention relates to a burner for operating a heat generator, wherein such a burner has a swirler for a combustion air flow, and also means for injecting at least one fuel into the combustion air flow. Downstream of the swirler, a mixing path is arranged, and in the region radially outside the discharge opening of the mixing path of the burner there is at least one nozzle for feeding liquid pilot fuel. Furthermore, the present invention relates to a method for operating such a burner.

2. Brief Description of the Related Art

Premix burners, as proposed for example in EP 0 321 809 B1, are burners in which a fuel, gaseous or liquid, is first mixed with the combustion air and after this mixing process is combusted in the flame. In the case of the type of such a premix burner which is proposed in EP 0 321 809 B1, a plurality of conical wall elements are provided, wherein these wall elements are arranged in an offset manner to each other in such a way that inlet slots for the combustion air into the interior of the burner are formed between them. In this region, therefore, a swirl is generated, and the swirled flow which is formed therein is then transferred into a mixing path. In such a burner both liquid as well as gaseous fuels can be combusted, wherein the former are preferably fed on the axis of the burner via a fuel lance, and the latter are fed in the region of the inlet slots, typically via a multiplicity of exit orifices which are arranged in series. Such burners are characterized by an outstanding stability of the flame and also by excellent pollutant values (low NOx values) and efficient heat generation.

A further improvement of such a construction is described, for example, in documents EP 0 704 657 B1 and EP 0 780 629 B1. In this case, a mixing path is also arranged downstream of the swirler formed by the conical wall elements, and specific transfer passages, which ensure an ideal transfer of the flow which is formed in the swirler into the mixing path, are provided at the inlet of this mixing path.

In the case of such burners, the fact that they have the tendency to become unstable, if for example they are controlled under low-load conditions or under transient conditions with a low fuel supply, is problematical. This is because, inter alia, such burners ideally have to be operated close to the lean quenching limit in order to have the aforementioned advantages. If the fuel supply is lowered below a critical value, then quench pulsations can occur, that is to say a quenching of the flame can be caused as a result of oscillations in the combustion chamber (so-called thermoacoustic instabilities).

In order to avoid such problems, a so-called pilot mode had been proposed on a number of occasions, that is to say an operating mode in which special additional fuel nozzles, which can be controlled under such low-load conditions or in the case of transient conditions, are arranged at suitable places of the burner or in the combustion chamber.

So, for example, EP 0 994 300 B1 describes the possibility of injecting gaseous pilot fuel in the case of a burner of the type as is described in EP 0 704 657 B1 or in EP 0 780 629 B1, this virtually being at the front edge of the mixing path, wherein swirl generators are additionally arranged in the region of the outlet of this pilot fuel. As a result of the vortex plaits which are created on the swirl generators, an increased mixing of the combustion air with the pilot fuel is brought about, and higher stability of the combustion process and lower pollutant values accordingly. As a result, the effect can be achieved of the operating range of such a burner being able to be extended to the bottom end with constant pollutant values.

Another possibility for feeding gaseous pilot fuel is described in EP 0 931 980 B1, wherein the gas in a discharge ring of the burner, after mixing with combustion air, is ignited by an ignition unit and injected into the combustion chamber.

While the aforementioned systems relate exclusively to the feed of gaseous pilot fuel, EP-A-1 389 713 in addition also describes the feed of liquid pilot fuel, after mixing with combustion air, into the combustion chamber very close to the discharge opening of the burner, this feed also being on the front outlet edge which faces the combustion chamber and specifically from a conical flank of the discharge ring which is bevelled outwards and towards the burner rear wall. Since liquid fuels on the one hand as a rule are more easily combustible, the pilot mode can also be maintained beyond the partial load, and since when feeding liquid fuel after shutting down it is not mandatory to be purged with air, this is of great advantage.

In order to get a grip on the problem of the excessive heat which occurs in the region of the outlet edge, the feed via fuel pipes with discharge openings arranged at their ends is described in EP-A-1 389 713, wherein the discharge openings do not lead directly into the combustion chamber, but, rather, lead into an encompassing cavity in the discharge ring which is arranged in the region of the outlet edge directly next to the burner opening and which is purged with combustion air and has holes which are arranged above the discharge openings or nozzles respectively and through which the liquid fuel can discharge into the combustion chamber from the said flanks. In order to be able to ensure the stability of the pilot flame, the fuel is introduced into the combustion chamber in a jet which is arranged in a plane which includes the axis of the burner. It is specified that the jet with the axis of the burner forms an angle within the range of 15 to 600. The discharge openings are indeed exposed to circumflow on their surface which faces the combustion chamber by the combustion air which is fed in the ring, but the cooling still has optimization requirements because an uneven distribution of the air through the air ring occurs, and consequently an uneven cooling. There is also the fact that the cold fuel in this case gives rise to a high temperature gradient which leads to high stresses.

For better mixing of the liquid fuel with the combustion air, it is necessary, moreover, to arrange swirl generators for the liquid fuel in the feed line upstream of the nozzle which is arranged at the discharge opening. It is specifically disclosed that, for example, a perforated plate, with at least two holes for the generation of such turbulence and which is installed in the pipe cross sections of the feed pipe, can be used.

Since the pilot nozzle for the liquid fuel is integrated in the discharge ring in a fixed manner, and the same purging air is used as for the gas pilot, there is a further disadvantage of the solution which is known from EP-A-1 389 713, in that in case of damage, the entire burner head has to be exchanged which gives rise to high costs.

SUMMARY

One of numerous aspects of the present invention includes an improved burner which can be operated with liquid fuel in pilot mode. In particular, stable operation with low pollutant values can be achieved, as well as avoidance of overheating of components. Furthermore, a construction which is modularized as far as possible can be provided, which for example allows replacement of the elements of the pilot burner. Specifically, it concerns the improvement of a burner for operating a heat generator in this case, wherein the burner comprises a swirler for a combustion air flow, and also means for injecting at least one fuel into the combustion air flow, wherein a mixing path is arranged downstream of the swirler, and wherein at least one nozzle for feeding liquid pilot fuel is arranged in the region radially outside the discharge opening of the mixing path of the burner. In principle, therefore, it concerns a burner of the type as is described in EP 0 321 809 B1, wherein in addition, as this is described for example in EP 0 704 657 B1 or in EP 0 780 629 B1, transfer passages can be arranged between the swirler and the mixing path.

Another aspect of the present invention includes the at least one nozzle being arranged in a burner front plate, wherein in a front face of the burner front plate, which is arranged essentially parallel to a combustion chamber rear wall, at least one discharge opening is provided, through which the liquid pilot fuel discharges into the combustion chamber. This burner front plate with its front face which is arranged parallel to the combustion chamber rear wall, which is arranged outside the discharge opening of the burner, allows the feed of pilot fuel to be integrated into the burner, but to be arranged nevertheless at sufficient distance from the discharge opening of the burner. In this way, overheating of constructional components of the burner occurring during pilot mode can be avoided. As a result of a direct feed of screening air (purging air), the atomization of the liquid pilot fuel is assisted and coking is avoided, and also a local backflow is prevented. Moreover, as a result of the arrangement in the front face, a better atomization of the fuel can be ensured. The injection angle in this case can be kept smaller in comparison to the prior art, since injection is carried out far enough from the burner outlet edge.

Furthermore, a modular type of construction is advantageously possible, that is to say on account of the fact that the elements of the pilot burner are not arranged in the discharge ring of the burner, as in the case of EP-A-1 389 713, these elements are better accessible and can be easily exchanged, which saves costs.

Specifically, a burner of the aforementioned type typically has a central section which adjoins the burner opening and which, with regard to a burner axis, is formed in a manner in which it slopes radially outwards and conically rearwards, and forms a bevelled flank. The burner front plate can now be formed in one piece with such a section, that is to say, can have a central section which adjoins the burner opening and which, with regard to a burner axis, is formed in a manner in which it slopes radially outwards and conically rearwards, and forms a bevelled flank. In this case, the at least one discharge opening, with regard to the burner axis, is arranged radially outside this flank according to a preferred embodiment of the invention.

Alternatively, it is possible that a discharge ring is arranged between the burner front plate and the burner opening, and which, with regard to a burner axis, is formed in a manner in which it slopes radially outwards and conically rearwards, and forms a bevelled flank. Also in this case, the discharge opening, with regard to the burner axis, is arranged radially outside this flank.

A further preferred embodiment of the invention is characterized in that the burner front plate has a plurality of discharge openings which are arranged in an encompassing manner, wherein the burner front plate has at least one inlet opening, in most cases provided behind a rear wall of the combustion chamber, and through which combustion air from outside can enter the burner front plate and, as a result of the pressure drop towards the combustion chamber, can flow through the discharge openings. In this way, an optimum cooling of the edge region and also of the burner front plate can be ensured.

According to one embodiment of the invention, one nozzle only per burner is arranged behind a discharge opening.

Preferably, it is possible to form the nozzle as a plain jet or as a pressure swirl nozzle. A pressure swirl nozzle is preferred in this case, at least with regard to the pollutant values.

A pressure swirl nozzle is a nozzle in which the fuel under high pressure is first guided via, for example, tangentially extending slots into a swirl chamber and then leaves this swirl chamber via a nozzle orifice. Consequently, a spray cone results, in which the fuel is broken up into extremely fine particles (in addition to this, compare, for example, Lueger, Lexikon der Technik, Stuttgart, 1965, Band 7, Seite 600 (Lueger, Dictionary of Technology, Stuttgart, 1965, volume 7, page 600)).

One aspect of the invention, therefore, is that a conventional plain jet injection, as this is described in EP-A-1 389 713, is not to be used, but rather a completely specific nozzle formation is to be used, that is to say a pressure swirl nozzle. That the use of a pressure swirl nozzle in connection with the pilot injection is on the whole possible, is quite unexpected. The fact that overheating in the region of the nozzle has to be avoided is problematical when injecting liquid fuel in the edge region of the burner, that is to say, in direct proximity of the combustion chamber. This can already be largely achieved by the arrangement of the pilot burner in the region of the front face of a burner front plate. When using a nozzle according to EP-A-1 389 713, this is partially ensured since the jet of fuel can be carried a long way into the combustion chamber and accordingly the flame is mostly, but not always, sufficiently far away from the rear wall of the combustion chamber. In the case of the fine droplet structure of a pressure swirl nozzle, it would have been generally to be expected for the flame to be located much too close to the rear wall and that, as a result, an excessive heating in the region of the nozzle would have to occur. Surprisingly, it now turns out, this is not the case.

A further embodiment exemplifying principles of the invention concerns a pressure swirl nozzle which produces a hollow spray cone and not a full fuel cone. For example, nozzles, as are described in EP 0 924 461 B1 or in EP 0 794 383 B1, can be used, but other constructions are also possible.

It is advantageous if the nozzle is arranged in a cavity in the burner front plate, which has a discharge opening to the combustion chamber through which the spray cone which is produced by the nozzle enters the combustion chamber, wherein the nozzle orifice is set back from the discharge opening with regard to the combustion chamber. This cavity is preferably a cavity which is essentially cylindrical, at least in the region of the nozzle and downstream of the nozzle, and in particular the inside diameter of this cavity is preferably equal to or smaller than the inside diameter of the discharge opening. The nozzle orifice is preferably offset rearwards by up to 50 mm from the front edge of the discharge opening which faces the combustion chamber.

An ideal combustion characteristic of the pilot flame can be realized if such a cavity has at least one inlet opening through which combustion air from outside enters the cavity and, as a result of the pressure drop towards the combustion chamber, can flow through the discharge openings. Consequently, a combustion air flow results, which virtually encompasses the spray cone and can ensure an optimum transporting into the combustion chamber and an enveloping of this spray cone. This is especially the case when the nozzle is arranged at the end of an essentially cylindrically formed fuel pipe which projects into the essentially cylindrical cavity and concentrically to this, so that the combustion air flows around the spray cone in an essentially encircling manner. This screening air (purging air) assists the atomization, and coking of the injector and local backflowing are advantageously avoided. The injection of the liquid pilot fuel is therefore carried out separately and is positioned with separate purging air in the case of each nozzle.

The discharge opening is preferably at least the same size as the cylindrical cavity in order to avoid flow losses. In order to be able to adjust the conditions, it proves to be advantageous to provide means upstream of the nozzle by which the throughflow cross section for combustion air in the cavity can be adjusted.

The nozzle is advantageously oriented in such a way that the principal axis of the spray cone which is produced by the nozzle is arranged in a plane which is formed by the principal axis and the central axis of the burner, wherein an angle $\gamma$ in the range of +/−45°, preferably in the region of 0°, is included between the principal axis of the spray cone which is produced by the nozzle (with a spray cone angle $\beta$ in the range of 0 to 90°) and the axis of the burner.

In this case, it is also possible to deviate from the plane by a tilt angle $\delta$ and in this way to ensure an injection virtually parallel, or at least obliquely at a small angle, to the rotational direction of the combustion air flow which discharges from the main opening of the burner.

Furthermore, the present invention relates to a method for operating a burner as described above. The method is especially characterized in that liquid fuel through the nozzle is used for producing pilot flames at least at low load or under transient conditions. As a result of the specific design of the nozzle, it is possible to control the pilot flame for stabilization both at nominal load and high load respectively.

BRIEF DESCRIPTION OF THE DRAWINGS

The invention is to be subsequently explained in more detail based on exemplary embodiments in connection with the drawings. In the drawings.

DETAILED DESCRIPTION OF EXEMPLARY EMBODIMENTS

Figure 1:
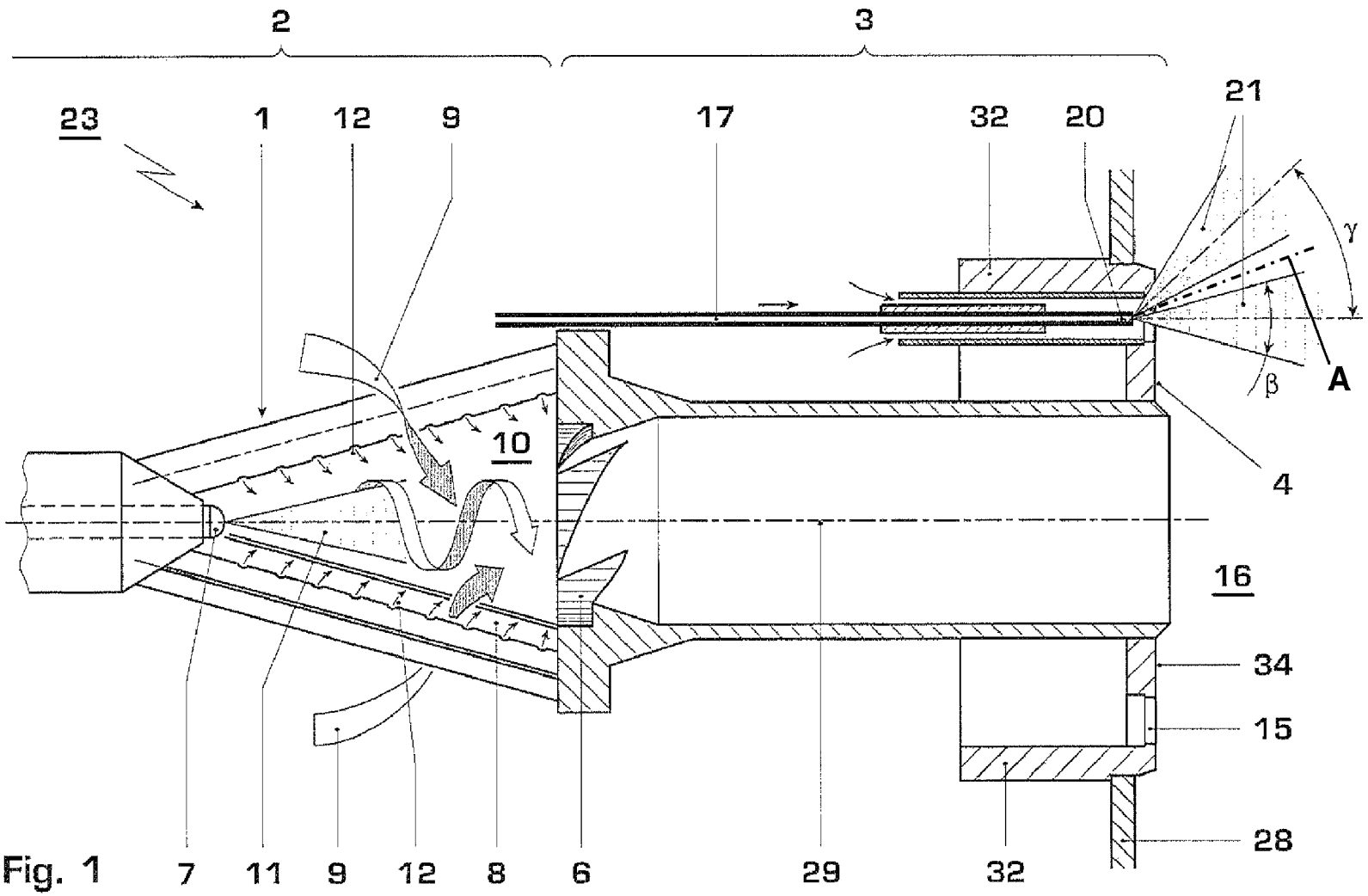
FIG. 1 shows an axial section through a double-cone burner with downstream mixing path and pilot burner for liquid fuel.

FIG. 1 schematically shows in a central section a burner of the type as is described for example in EP 0 704 657 B1 or in EP 0 780 629 B1. Such a burner 23 has a swirler 2 which is formed as a result of the offset arrangement of at least two conical body sections 1. As a result of this offset arrangement, tangential inlet slots 8 are formed between the two body sections 1. The combustion air 9 enters the burner cavity 10 through these tangential inlet slots 8, wherein a high swirl is generated. A fuel nozzle 7 for liquid fuels is arranged at the central apex of the cone.

The fuel which discharges from this fuel nozzle 7 forms a fuel cone 11 and is picked up by the tangentially inflowing combustion air 9 and enveloped by this, and a conical column consisting of a mixture of fuel and combustion air is formed. Gaseous fuel can be fed in the region of the tangential inlet slots 8 via additional fuel nozzles 12.

A mixing path 3 is connected downstream to this swirler 2. Transfer passages 6 are arranged in the transition from the swirler 2 to the mixing path 3, which assist the flow in this region and ensure an optimum entry into the mixing path 3. The mixing path 3 essentially includes a cylindrical tube. A burner front plate 32, which delimits the burner towards the combustion chamber 16 and also, if necessary, a discharge ring 4 completely on the inside, are now arranged at the end of this tube which faces the combustion chamber 16.

In the region of this burner front plate 32 or of the discharge ring 4, devices are provided in order to feed gaseous fuel for the pilot mode, as this is described for example in EP 0 931 980 B1 or in EP 0 994 300 B1. Furthermore, a feed for liquid pilot fuel is now also provided in the region of the burner front plate 32 or is integrated into this. For this purpose, a fuel pipe 17 is provided, which on its end which faces the combustion chamber has a pressure swirl nozzle 20 or a conventional pressure jet.

The at least one nozzle 20 is arranged in the burner front plate 32. At least one discharge opening 15, through which the pilot fuel discharges into the combustion chamber 16, is provided in a front face 34 of the burner front plate 32, which is arranged essentially parallel to a combustion chamber rear wall 28.

Figure 4:
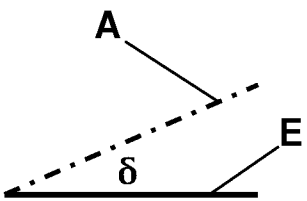
FIG. 4 schematically shows an angle $\delta$ of a spray cone.

The orientation of this pressure swirl nozzle or plain jet 20 can be arranged parallel to the axis 29 of the burner (see lower spray cone 21 with a spray cone angle $\beta$ in FIG. 1). However, it is also possible to incline the principal axis of the hollow cone spray 21 of pilot fuel which is produced by the pressure swirl nozzle 20 in a plane including the axis 29 of the burner, by an angle $\gamma$. Furthermore, it is possible to provide an inclination by a tilt angle $\delta$ (FIG. 4) from the spray cone axis A relative to the plane E (which includes or is parallel to the plane in which the sectional view of FIG. 1 is taken), in order to introduce the fuel in a manner which is adapted to the rotating movement of the combustion air from the burner. The spray cone angle $\beta$ preferably lies within the range of 0-90°.

Figure 2:
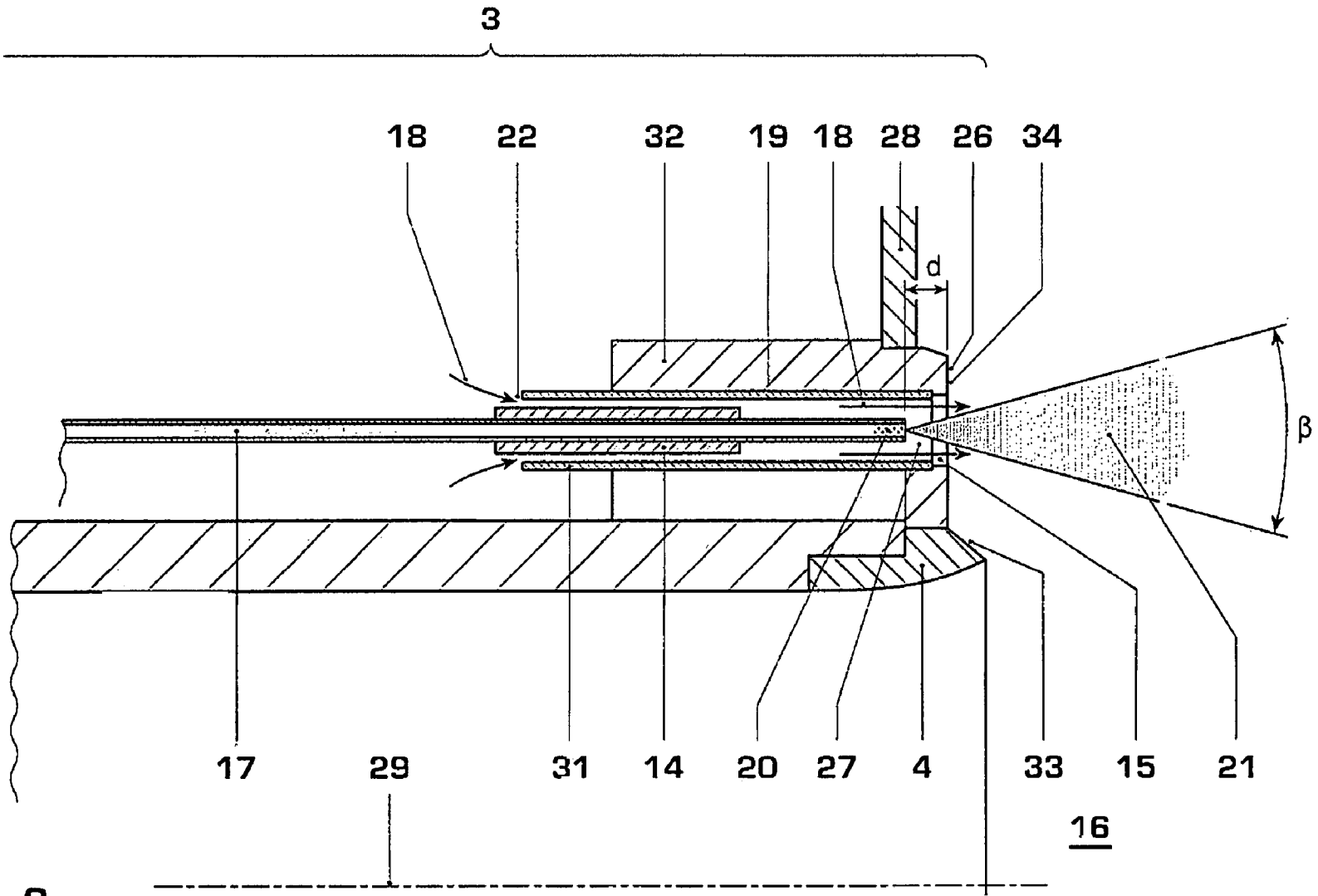
FIG. 2 shows a detail of a view according to FIG. 1 through the edge region of the burner in the region of the burner front plate.

In FIG. 2, a detailed section of the edge region of the burner in the region of the burner front plate of such a burner is shown. In this case, it is to be seen that the fuel pipe 17 enters the burner front plate 32 and is conically guided into a tube 31. A pressure swirl nozzle 20 (or similarly a plain jet in each case) is arranged at the tip of the fuel pipe 17. The pressure swirl nozzle in this case is set back by a distance d, which can be up to 50 mm, from the front edge 26 which faces the combustion chamber 16. This offset contributes to the pressure swirl nozzle 20 not being exposed to excessive heating by the combustion chamber. The tube 31 encloses a cavity 27. A discharge opening 15 is provided in the burner front plate 32 and has such a diameter that the hollow cone spray 21, which is formed by the pressure swirl nozzle 20, does not contact the discharge opening 15 during operation. The tube 31 has an inside diameter which at most is as large as, preferably the same size as, the inside diameter of the discharge opening 15 in order to avoid flow problems occurring as a result of a step. Furthermore, the tube 31 has an inlet opening 22 for combustion air 18 which faces away from the combustion chamber 16. This combustion air 18, as a result of the pressure drop towards the combustion chamber 16, is drawn in via the tube 31 and the cavity 27 and flows in the direction of the combustion chamber 16. An element 14 (for example an insert) can be provided for adjusting the flow. This combustion air flow 18, for which perhaps passages 19 can be provided, first flows around the fuel pipe 17, then the region of the pressure swirl nozzle 20, and then envelops the hollow spray cone 21 when discharging into the combustion chamber. The combustion air 18, therefore, also represents a screening air. It assists the atomization of the liquid fuel so that as a result of the uniform distribution of the fuel coking and local backflow are avoided. It not only makes sure that adequate cooling of the pressure swirl nozzle 20 is ensured, but it also leads to an ideal transfer of the hollow cone spray through the discharge opening 15 into the combustion chamber 16. Furthermore, the atomization of the fuel of the hollow cone on the boundary surface is liquidly/gaseously assisted.

As is indicated by the broken line, it is possible to provide a separate discharge ring 4 with a bevelled edge 33, but it is also possible to form the projection of such a discharge ring 4 integrally with the burner front plate 32 as one element.

Figure 3:
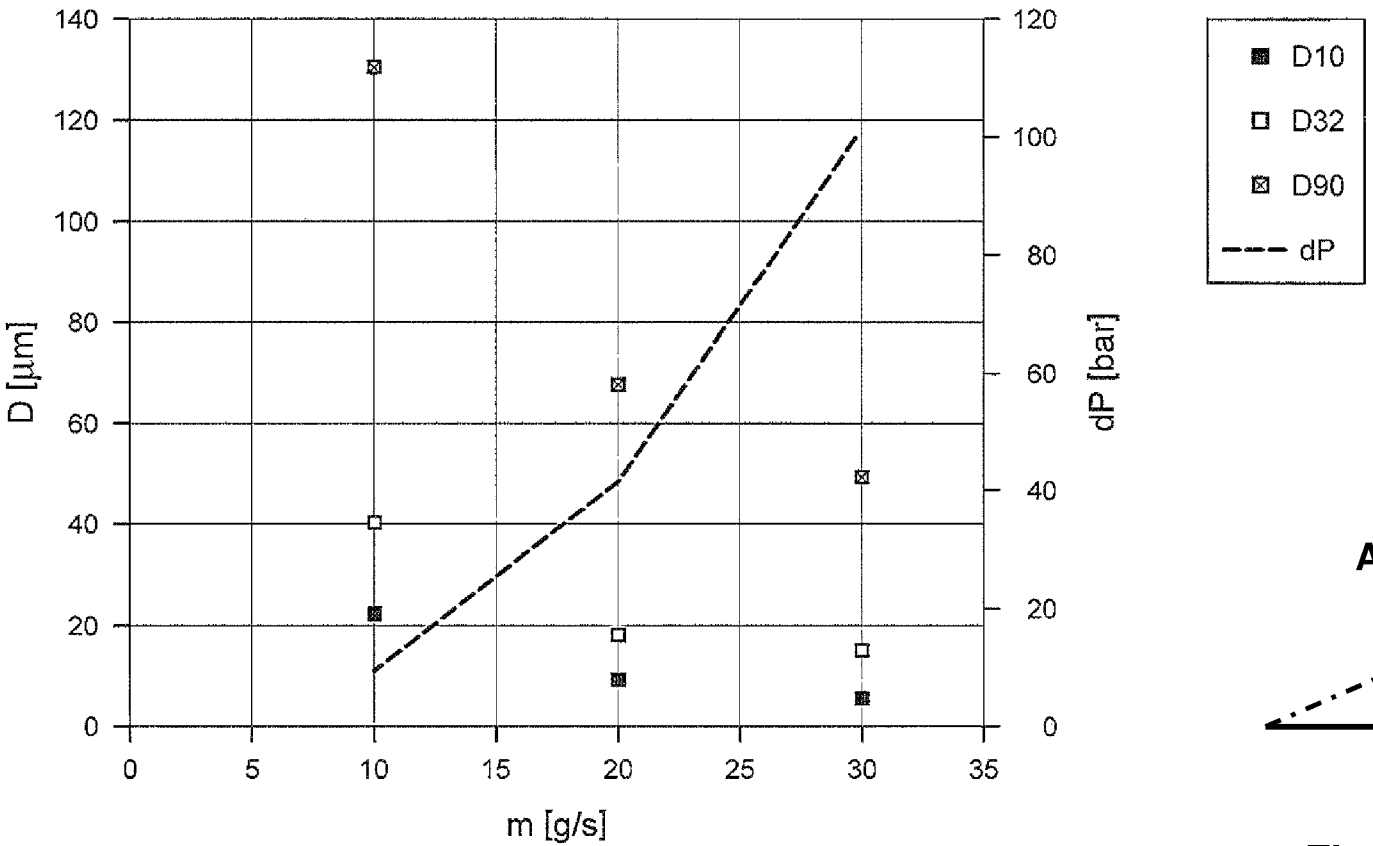
FIG. 3 shows characteristic quantities for a pressure swirl nozzle, Sauter mean diameter of the droplets (D), and also pressure drop (dP) as functions of the mass flow.

FIG. 3 shows how a size of droplets which is ideal for combustion can be produced from such a pressure swirl nozzle. It is specifically shown that even for low mass flow of fuel (plotted on the x-axis) on the one hand a small particle size results (for example D10 signifies at 10 g/s that 10% of the droplets are smaller than about 22 μm, and D90 signifies that 90% of the droplets are smaller than about 133 μm). Moreover, an optimum ratio of volume to surface (D32) for the combustion process over a wide range results. Also, the pressure drop under typical conditions when feeding fuel for pilot burners is moved within the suitable range.

LIST OF DESIGNATIONS

1 Conical body section
2 Swirler
3 Mixing path
4 Discharge ring
6 Transfer passages
7 Central fuel nozzle for liquid fuels
8 Tangential inlet slots
9 Combustion air, combustion air flow
10 Burner cavity
11 Central fuel cone of the liquid fuel
12 Tangential fuel nozzle for gaseous fuels
14 Insert
15 Discharge opening from 4
16 Combustion chamber
17 Fuel pipe for liquid pilot fuel
18 Combustion air for liquid pilot fuel
19 Passages for 18
20 Pressure swirl nozzle/plain jet
21 Hollow cone spray of pilot fuel
22 Inlet openings for combustion air 18
23 Burner
26 Front edge of the burner front plate facing the combustion chamber
27 Cavity for 20
28 Rear wall of the combustion chamber
29 Axis of the burner, burner axis
31 Tube
32 Burner front plate
33 Bevelled flank of 4
34 Front face of 32
d Distance between nozzle 20 and front edge 26
β Spray cone angle
γ Angle between the principal axis of the spray cone and the axis of the burner While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A burner for operating a heat generator, the burner comprising:

a swirler for a combustion air flow;

means for injecting at least one fuel into the combustion air flow;

a mixing path downstream of the swirler and having a discharge opening, opening to a combustion chamber;

at least one nozzle, configured and arranged to feed liquid pilot fuel to the combustion chamber, arranged in a region radially outside the mixing path discharge opening;

a burner front plate having a front face, wherein the at least one nozzle is arranged in the burner front plate;

at least one discharge opening through which the liquid pilot fuel can discharge into the combustion chamber, the at least one discharge opening positioned in the burner front plate front face, the burner front plate front face arranged to be parallel to a combustion chamber rear wall;

means upstream of the nozzle for adjusting the throughflow cross section for combustion air in the burner front plate cavity;

wherein the burner front plate comprises a cavity;

wherein the at least one nozzle is arranged in the burner front plate cavity;

wherein the discharge opening forms an opening of the cavity to the combustion chamber through which a spray cone when produced by the at least one nozzle enters the combustion chamber; and wherein the at least one nozzle has an opening set back from the discharge opening relative to the combustion chamber; and wherein the burner front plate cavity has at least one inlet opening through which combustion air from outside can enter the cavity and, as a result of the pressure drop towards the combustion chamber, can flow through the discharge opening.

2. The burner as claimed in claim 1, wherein:

the burner front plate has a central region which adjoins the mixing path discharge opening and which, with regard to a burner axis slopes radially outwards and conically rearwards, and forms a bevelled flank; and the least one discharge opening is arranged radially outside said central region with regard to the burner axis.

3. The burner as claimed in claim 1, wherein:

the burner front plate comprises a plurality of discharge openings arranged around the burner axis; and the burner front plate has at least one inlet opening through which combustion air from outside can enter the burner front plate and, as a result of the pressure drop towards the combustion chamber, can flow through the discharge openings.

4. The burner as claimed in claim 3, wherein only one nozzle is arranged behind each discharge opening.

5. The burner as claimed in claim 1, wherein the at least one nozzle comprises a plain jet nozzle or a pressure swirl nozzle.

6. The burner as claimed in claim 5, wherein the at least one nozzle comprises a pressure swirl nozzle configured and arranged to produce a hollow cone spray.

7. The burner as claimed in claim 6, further comprising:

a cylindrical fuel pipe having an end;

wherein the burner front plate cavity is cylindrical;

wherein the at least one nozzle is positioned at the end of the fuel pipe; and wherein the fuel pipe projects into and concentric with the burner front plate cylindrical cavity so that combustion air can envelopingly flow around the spray cone.

8. The burner as claimed in claim 1, wherein:

the at least one nozzle is configured and arranged so that the principal axis of a spray cone produced by the at least one nozzle is arranged in a plane which is formed by said principal axis and a central axis of the burner; and an angle $\gamma$ in the range of $+/-45°$ is formed between the spray cone principal axis, when produced by the nozzle, and the burner axis.

9. The burner as claimed in claim 8, wherein the angle $\gamma$ is about 0°.

10. The burner as claimed in claim 8, wherein the spray cone is inclined from a plane formed by the principal axis and the burner central axis by a tilt angle $\delta$, to introduce the input of the liquid pilot fuel in the direction of the rotating combustion air flow from the burner.

11. A method for operating a burner for operating a heat generator, the method comprising:

providing a burner having a swirler for a combustion air flow;

means for injecting at least one fuel into the combustion air flow;

a mixing path downstream of the swirler and having a discharge opening, opening to a combustion chamber;

at least one nozzle, configured and arranged to feed liquid pilot fuel to the combustion chamber, arranged in a region radially outside the mixing path discharge opening; a burner front plate having a front face, wherein the at least one nozzle is arranged in the burner front plate; and at least one discharge opening through which the liquid pilot fuel can discharge into the combustion chamber, the at least one discharge opening positioned in the burner front plate front face, the burner front plate front face arranged to be parallel to a combustion chamber rear wall;

wherein the burner front plate comprises a cavity;

wherein the at least one nozzle is arranged in the burner front plate cavity;

wherein the discharge opening forms an opening of the cavity to the combustion chamber through which a spray cone when produced by the at least one nozzle enters the combustion chamber;

wherein the at least one nozzle has an opening set back from the discharge opening relative to the combustion chamber, wherein the burner front plate cavity has at least one inlet opening through which combustion air from outside can enter the cavity and, as a result of the pressure drop towards the combustion chamber, can flow through the discharge opening; and means upstream of the nozzle for adjusting the through-flow cross section for combustion air in the burner front plate cavity; and producing pilot flames with liquid fuel via said nozzle at low load or under transient conditions.

12. The method as claimed in claim 11, further comprising:

controlling the pilot flames for stabilization both at nominal load and high load.

* * * * *